United States Patent [19]

Yunik et al.

[11] 4,378,486

[45] Mar. 29, 1983

[54] TEMPERATURE CONTROLLED TIMER

[75] Inventors: Maurice Yunik, Ile Des Chenes; David Waldman, Winnipeg, both of Canada

[73] Assignee: The Conserver Group Inc., Winnipeg, Canada

[21] Appl. No.: 220,688

[22] Filed: Dec. 29, 1980

[30] Foreign Application Priority Data

Apr. 24, 1980 [CA] Canada ..... 350586

[51] Int. Cl.[3] ..... H05B 1/02

[52] U.S. Cl. ..... 219/492; 219/508; 219/493; 219/202; 236/46 A; 236/46 C

[58] Field of Search ..... 219/492, 202, 203, 491, 219/493, 497, 508, 509; 368/110, 111, 113; 165/12; 236/46 R, 46 A, 46 C, 91 C

[56] References Cited

U.S. PATENT DOCUMENTS

| | | | |
|---|---|---|---|
| 4,040,565 | 8/1977 | Christiansen | 236/91 R |
| 4,102,495 | 7/1978 | Flynn et al. | 236/46 R |
| 4,106,690 | 8/1978 | Tomlinson | 236/46 R |
| 4,177,388 | 12/1979 | Lingenfelter | 307/39 |
| 4,206,872 | 6/1980 | Levine | 236/46 R |
| 4,214,171 | 7/1980 | Gyori | 307/39 |
| 4,277,018 | 7/1981 | Nelson | 236/46 R |

*Primary Examiner*—M. H. Paschall

*Attorney, Agent, or Firm*—Edward E. Pascal

[57] ABSTRACT

A temperature controlled timer useful for controlling the application of power to apparatus such as automobile block heaters or the like. In one embodiment the time of application of power prior to a shut off time is decreased with increasing ambient temperature. In another embodiment the duty cycle of cyclically applied power is changed so that the power on period becomes shorter and the power off period becomes longer with increasing ambient temperature. Significant conservation of power results.

9 Claims, 4 Drawing Figures

TEMPERATURE CONTROLLED TIMER

This invention relates to a timer, and particularly to a temperature controlled timer which can be used for energy conservation.

BACKGROUND OF THE INVENTION

In cold climates an internal combustion engine often requires the use of auxiliary heaters, such as electrical block heaters, in order to lower the viscosity of the engine lubricants and possibly to improve the vapourization of fuel, and thus provide reliable starting. Sometimes a battery warmer is also used, an in-car heater, etc., all of which are electrically operated, and typically use large amounts of power. It is the practice of many drivers to connect the electrical power to the aforenoted heaters upon parking the car in a parking lot during the day or at home in the evening. Consequently heat is generated and power is dissipated for the entire parking period, e.g., all night.

Timers, usually with a clockwork mechanism, have become available and are sometimes connected between the source of power and the automobile heater. These types of timers are usually manually set to turn the heater on after a predetermined off time. Since the heater need be turned on only a relatively short time before the automobile is to be used, it usually is on for only a fraction of the total number of hours that the automobile in unused, and significant energy savings are achieved. However it should be noted that once the timer has switched the power on, full power is applied to the heaters whether the outside temperature is near freezing, or, for instance, a very cold −20° F.

The operators of parking lots in cold climates also often provide electrical outlets for supplying power to the aforenoted block heaters, etc., in order that their patrons should be able to start their autos should they return at any time during the day. Again, full power is provided whatever is the ambient temperature. In this case timers as described earlier could not satisfactorily be used by the parking lot operator since he cannot be aware of when patrons might wish to start their autos.

In order to conserve energy a home thermostat has been made available, which, under control of a timer, switches from one thermostatic setting to a second, the latter being set at a lower temperature, during sleeping hours. This thermostat therefore contains means for switching power to a furnace controlling load with changes in temperature, and means for reducing the power supplied at a given time, as set by the thermostat clock.

SUMMARY OF THE INVENTION

The present invention provides means for reducing a preset time of application of power with increase in ambient temperature, rather than controlling the applied power with temperature, and reducing it with time as in the aforenoted controlled thermostat. Using the timer of the present invention, an operator would set the time that he wishes to use his parked car in the morning, and also would set a time interval prior to that time during which he wishes the power to be applied, assuming a given ambient temperature. Thus he operates it in a manner analogous to the clockwork type of timer described above. However, according to the present invention, the interval that the power is applied is modified by the ambient temperature. Should the ambient temperature rise during the night, clearly the amount of time necessary to warm the engine decreases, and the "power on" interval automatically shortens. Similarly, if the temperature drops, increased engine warming time is necessary and the "power on" interval increases to a predetermined maximum. It has been found that significant energy savings are thus achieved, since the amount of electrical power which is used to heat the automobile engine is made dependent on the warming requirements, which is of course dependent on the environmental temperature. If desired rather than utilizing the ambient temperature as the controlling factor, the wind chill factor can be used.

For the parking lot operator, power to the electrical outlets can be cycled on and off. For example, the electrical outlets at one-half of the parking spaces can be cycled on, while during the same interval the other half is cycled off. As the cycle advances, the outlets which were on are turned off and the outlets which were off are turned on. Of course the parking lot outlets can be segmented into thirds, quarters, etc. with various groups turning on and off according to a predetermined cycling plan.

According to the present invention, however, the amount of time that the power is turned on to individual electrical outlets is modified according to the environmental temperature (or wind chill factor). Thus as the temperature increases, the power on period decreases and as the temperature decreases, the power on period increases to a predetermined maximum. For the case in which the parking lot is split into two groups, at a specified low temperature and below that temperature, power is supplied to each of the two groups alternately for one half the total time period. Yet at a specified high temperature, the amount of time that power is supplied alternately to the two electrical outlets reduces to zero within the sequence period.

It may thus be seen that significant energy savings are achieved since previously during the power on period, continuous maximum power was supplied based on the possibly erroneous condition of coldest ambient temperature, but by the use of the present invention, the amount of power which is supplied is reduced with increasing ambient temperature.

In general, the inventive temperature controlled timer is comprised of a first circuit for controlling the application of power to a load for a predetermined period of time, a temperature sensor for sensing the ambient temperature, and a second circuit interconnected with the sensor and the first circuit for reducing the period of time of application of the power with increase in ambient temperature.

In one embodiment, the first circuit is adapted to cycle the application of the power on and off for predetermined periods of time, and the second circuit is adapted to reduce the on portion and increase the off portion of each cycle with increase in ambient temperature.

In a further embodiment, the first circuit includes a manually settable clock for indicating both a desired time period for application of the power and a period termination time, and the second circuit is comprised of means for shortening the desired period with increasing ambient temperature and controlling the application of power for the aforenoted shortened period of time prior to the period completion time.

INTRODUCTION TO THE DRAWINGS

A better understanding of the invention will be obtained by reference to the detailed description below, and to the following drawings, in which.

DESCRIPTION OF PREFERRED EMBODIMENTS OF THE INVENTION

Figure 1:
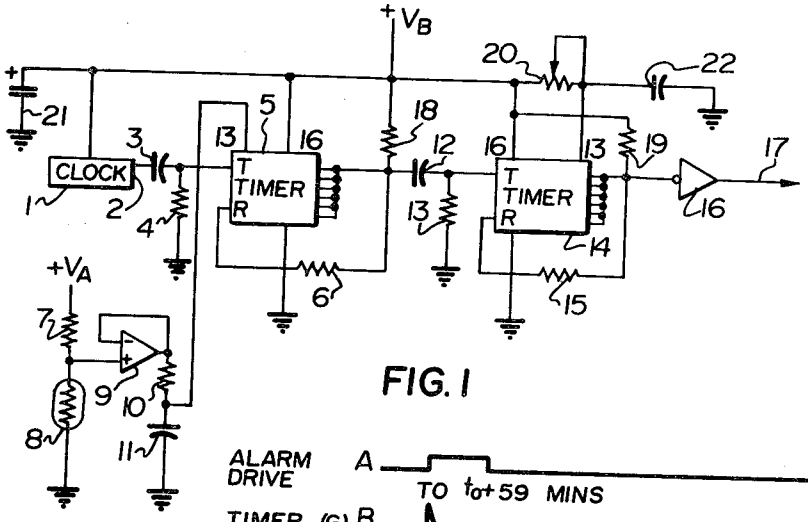
FIG. 1 is a schematic diagram of one embodiment of the invention.
Figure 2:
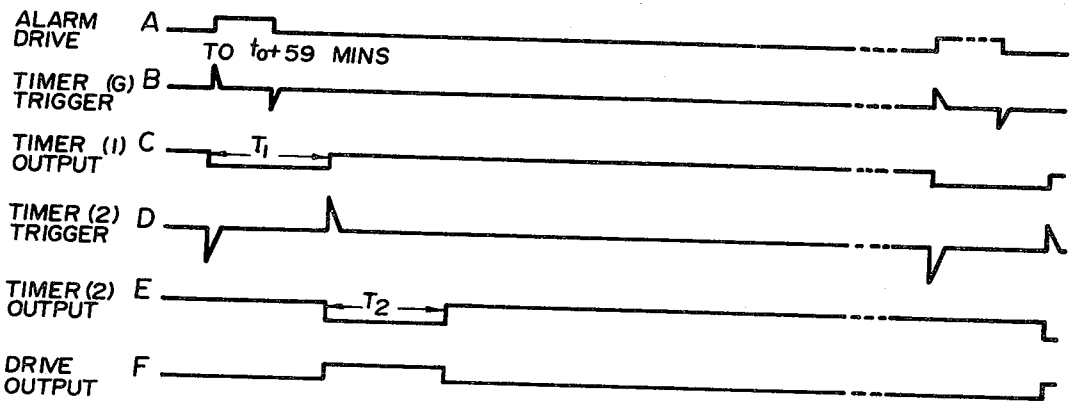
FIG. 2 is a waveform diagram of signals at various points in the circuit of FIG. 1.

Turning first to FIGS. 1 and 2, a digital alarm clock module 1 is utilized, which has an alarm drive output 2. The digital clock used in a successful prototype was type MM5042/MM5045 available from National Semiconductor Inc. The digital clock operates from standard 60 hertz 120 volt domestic power supply.

Connected to the output 2 of clock 1 is a differentiator circuit comprising series capacitor 3 and shunt resistor 4 which is also connected to ground. The output of the differentiator, that is, the junction between capacitor 3 and resistor 4 is connected to the T input of a timer 5. The timer in the aforenoted prototype was type XR 2240, from Exar Integrated Systems Inc., of the United States. The timer was connected in a monostable circuit arrangement, the details of which are understood by persons skilled in the art. The outputs of timer 5 are connected together, and also through resistor 6 to its reset input R.

A temperature sensing circuit is utilized, comprising the series circuit of resistor 7 and thermister 8, which are connected between a source of potential $+V_A$ and ground. The thermistor can be Philips type 213BD P4K7 or the equivalent.

The junction between resistor 7 and thermistor 8 is connected to the non-inverting input of an operational amplifier 9, such as type 741. The output of operational amplifier 9 is connected through an R-C circuit comprising resistor 10 in series with capacitor 11 to ground. The junction of resistor 10 and capacitor 11 is connected to terminal 13 of the aforenoted timer circuit.

The output of timer 5 is connected through a second differentiating circuit comprising series capacitor 12 and shunt resistor 13 which is connected to ground, to the T input of timer 14. The outputs of timer 14 (preferably type XR 2240) are connected together, and through resistor 15 to the reset input. The output is also connected through inverter 16 to output lead 17.

The outputs of timers 5 and 14 are individually connected to a source of potential $+V_B$ through resistors 18 and 19 respectively.

Timing adjust terminal 13 of timer 14 is connected to source of potential $+V_B$ through potentiometer 20. Timers 5 and 14 are also of course connected to source of potential $+V_B$ and ground for operating current, the source being bypassed by filter capacitor 21 to ground. The timing input terminal 13 of timer 14 is also bypassed to ground through capacitor 22.

In operation, the alarm of clock 1 is set at a time desired by the operator for power to be applied. For example, assuming that the operator is an automobile driver wishing to cause his block heater to turn on at a predetermined time, such as 3 a.m. (for very cold temperatures) the alarm of the clock is set at $T_1$ minutes before 3 a.m. At the set alarm time, an output pulse of the form of alarm drive waveform A is produced by the clock module 1 on alarm output 2. The output pulse thus begins at time $t_0$ and ends typically 59 minutes later, $t_0+$ 59 min.

The leading and trailing edges of this output pulse are differentiated in the differentiation circuit comprising capacitor 3 and resistor 4, and short trigger pulses of the form of waveform B are applied to input T of timer 5. This triggers the timer to begin timing a period shown as waveform C, the timer output signal.

The time $T_1$ of the timer output is set by the voltage across capacitor 11. This in turn is determined by resistor 9 in series and the voltage at the junction of resistor 7 and thermistor 8 (which forms a voltage divider) which is applied to the input of operational amplifier 9. When the temperature rises, the resistance of thermistor 8 drops, and the resulting lower voltage applied to terminal 13 of timer 5 to cause the time taken to reach the timer output pulse shut off threshold to increase the timing period $T_1$. Conversely if the ambient temperature decreases, the resistance of thermistor 8 increases, with the opposite effect, that of decreasing timer period $T_1$.

The output pulse shown in waveform C is differentiated in the differentiation circuit comprising capacitor 12 and resistor 13, and the resulting trigger pulses at the leading and trailing edges, as shown in waveform D, are applied to the trigger input T of timer 14. Since it is the positive-going pulse which initiates timing, timer 14 is triggered at the end of the time period $T_1$, and provides an output pulse at shown in waveform E, having time period $T_2$.

The time period $T_2$ is established by the time for capacitor 22 to charge to the timer 14 output pulse shut off threshold, in timing circuit comprising capacitor 22 and potentiometer 20. A front panel dial for potentiometer 20 is calibrated for the duration of desired power flow. The operator, for example, might set it at "5 hours". In originally setting up the controls, the operator will set the clock to turn on at typically 3 a.m., and to operate for five hours (i.e., turning off at the expected time of his return, 8 a.m.). The pulse length of waveform E, at the output of timer 14, would therefore be five hours.

The output pulse from timer 14 is applied to the input of inverter 16, which converts it to a positive-going pulse, in order to drive a solid state relay or the like (not shown).

Since the period $T_1$ increases with higher ambient temperatures, it will be noted that at higher ambient temperatures the period $T_2$ begins later. For example, if the temperature rises during the night, the end of period $T_1$ might occur at 4 a.m., rather than 3 a.m. Therefore the period $T_2$ will begin at 4 a.m., rather than 3 a.m. Since the operator had intended returning to his car at 8 a.m., the period of application of power will have been cut by one hour, with the saving of one hour of the application of full power to the electric heater.

In this manner, the switch on time of the apparatus is continuously variable, and increases during colder ambient temperatures and decreases during warmer ambient temperatures.

To measure wind chill rather than temperature, a metal block (heat sink) and a heating resistor connected between $V_A$ and ground should be located in the vicinity of the resistor 8.

It should be noted that this apparatus is useful to control various kinds of loads where the start up time is variable as a function of temperature. Further, it may be desirable to leave certain leads powered for given lengths of time after switch-on, and the shut-off time thus can be controlled either by the described timer, or by an auxiliary timer which can be set to a time-of-day shut-off time. The present invention is thus not limited to the control of parking lot or automotive loads.

Figures 3, 4:
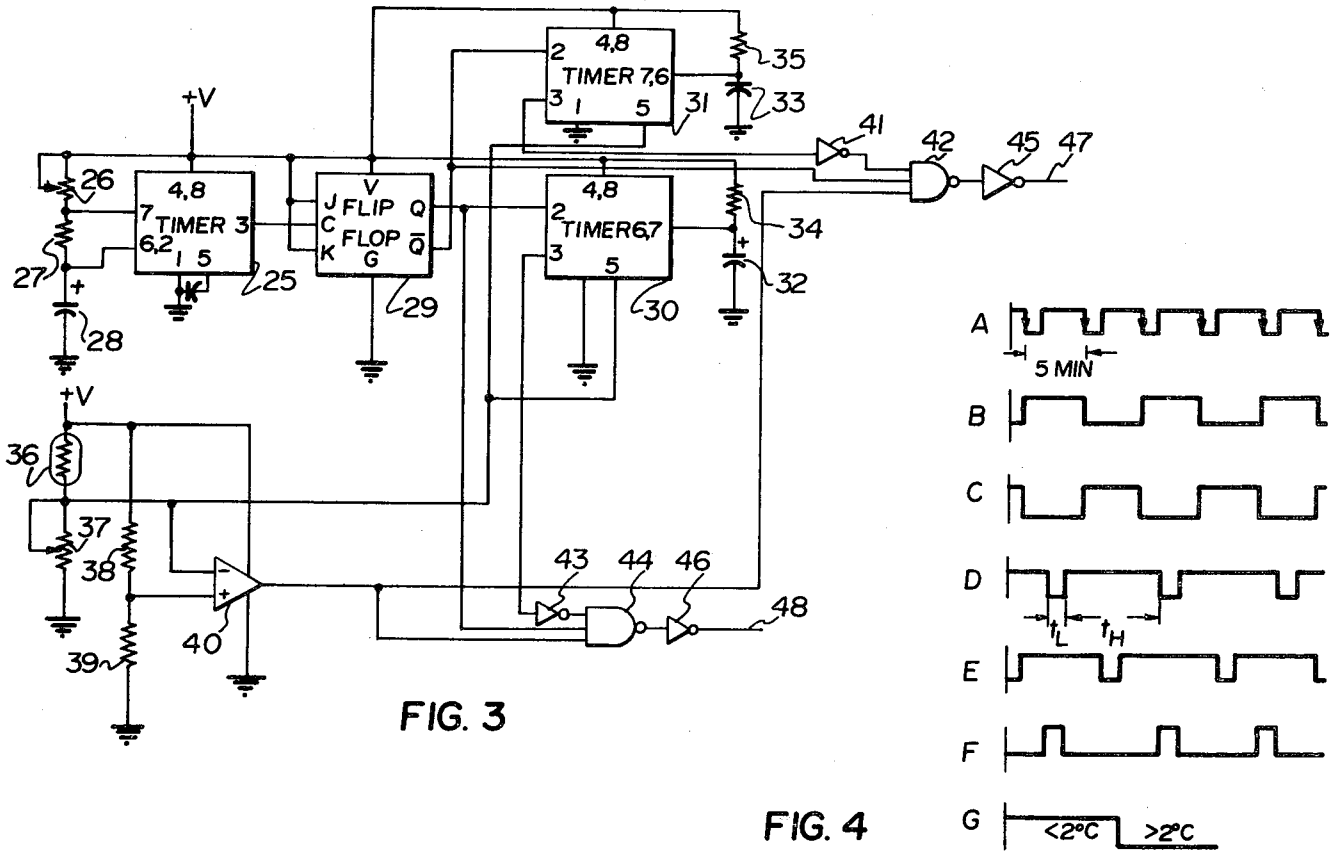
FIG. 3 is a schematic diagram of a second embodiment of the invention.
FIG. 4 is a waveform diagram of signals at various points of the circuit of FIG. 3.

Turning now to FIGS. 3 and 4, a schematic diagram and waveform diagram of a second embodiment of the invention is shown. This embodiment can be advantageously used to control the application of power to parking lot outlets. Either all of the parking lot outlets can be driven with a given duty cycle (for example 5 minutes on, 5 minutes off) of input power under control of the subject invention, or the parking lot outlets can be split into groups, for example two groups of 50%, and each driven alternately. The preferred embodiment describes a circuit by which 50% of each of the outlets are driven alternately.

A timer 25, such as type 555 is connected in a well known manner to operate in its astable mode. The frequency of oscillation is established by means of potentiometer 26, resistor 27 and filter capacitor 28 which are series connected between a source of potential +V and ground. The junction of potentiometer 26 and resistor 27 is connected to terminal 7 of the 555 timer and the junction between resistor 27 and capacitor 28 is connected to terminals 6 and 2 of the timer. Terminal 1 is connected to ground and terminals 4 and 8 to source of potential +V.

Output terminal 3 is connected to the clock input C of J-K flip flop 29. Both J and K inputs are connected to source of potential +V, in order that the flip flop should be toggled in synchronism with timer 25. Flip flop 29 is of course also connected between source of potential +V and ground. Timer 25 and flip flop 29 thus provide a clock circuit. It is preferred that the clock should provide output pulses of five minutes duration, which has been found to be useful to drive parking lot heater power outlets. Of course other times may be used for the desired application.

The Q output thus provides five minute positive-going pulses, and is connected to input 2 of timer 30, and output $\overline{Q}$ provides five minute negative-going output pulses, and is connected to input 2 of timer 31. Input 2 of both timers are the drive inputs of 555 type timers, which are preferred for timers 30 and 31.

Timers 30 and 32 are operated as monostable multivibrators, and their inputs trigger them, initiating output pulses at terminal 3. Filter capacitor 32 and 33 are respectively connected from terminals 6 and 7 of each of timers 30 and 31 to ground, and resistors 34 and 35 connected between the same terminals to source of potential +V.

A thermister 36, such as Philips type 213BD P4K7 or the equivalent is connected in series with potentiometer 37 between potential +V and ground. The junction between thermistor 36 and resistor 37 is connected to the duty cycle variation input of both timers 30 and 31, terminal 5 in the 555 type noted above.

A second voltage divider comprising resistors 38 and 39 is connected between +V and ground, and the junction between the resistors is connected to the non-inverting input of operational amplifier 40. The inverting input of operational amplifier 40 is connected to the junction between thermister 36 and potentiometer 37.

The output of timer 31 (at terminal 3 in the 555 type) is connected through buffer 41 to one input of NAND gate 42. The output of timer 30 is connected through buffer 43 to one input of NAND gate 44. A second input of NAND gate 42 is connected to $\overline{Q}$ output of flip flop 29 and the second input of NAND gate 44 is connected to the Q output of flip flop 29. Third inputs of both of NAND gates 42 and 44 are both connected to the output of operational amplifier 40. The outputs of NAND gates 42 and 44 are respectively connected through buffers 45 and 46 to output leads 47 and 48.

In operation, timer 25 provides an output signal at clock input C of flip flop 29 of the form of waveform A. The preferred (but not essential) period of the waveform is five minutes. The Q output of flip flop 29 is of the form of waveform A, and the $\overline{Q}$ output is of the form of waveform B. A comparison of waveforms A and B shows that output Q of flip flop 29 carries an output signal comprising pulses having leading and trailing edges corresponding to the leading edge of each negative-going pulse of waveform A. Waveform B is therefore the form of the output signal at the Q output of flip flop 29 and waveform C is the inverse at output $\overline{Q}$. It may be seen that the cycle time for each of the outputs of flip flop 29 is 10 minutes, comprising alternate 5 minute pulses of opposite polarity.

The outputs of timers 30 and 31, at their respective terminals 3 are of the form of waveforms D and E. These waveforms are comprised of two components, indicated in waveform D as $t_L$ and $t_H$. The relative time length of $t_L$ and $t_H$ is controlled by the D.C. input voltage at terminals 5 of timers 30 and 31, which is connected to the junction of thermister 36 and potentiometer 37.

Initially potentiometer 37 is set to establish a predetermined duty cycle of waveforms D and E, for example 50% where the thermistor 36 senses an ambient temperature which is at a predetermined low level, for example −30F. Accordingly, as the ambient temperature increases, the time $t_H$ increases and $t_L$ increases. At about 32° F., $t_L$ is decreased to about 10% of the complete cycle time, or about 1 minute.

The output signals from timers 30 and 31 are inverted in inverting buffers 41 and 43, and are respectively applied to one input of NAND gates 42 and 44. Waveform F, the form of the signal at the output of buffer 45, is the inverse of waveform D, applied thereto; (the inverse of waveform E is not shown).

These signals on leads 47 and 48 control the duty cycle of an external switch controlling the power outlets of a parking lot or the like. Clearly the "on" period decreases with increasing temperatures, and increases with decreasing to a 50% duty cycle. In the noted prototype, the duty cycle of power relays were controlled with an approximately straight line relationship from 5 minutes at −30° F. to one minute at +32° C.

It is also preferred to control the output control signal so that power is completely shut off above water freezing temperatures. The output signal of operational amplifier 40 is of the form of waveform G. Where the D.C. voltage at the junction of thermistor 36 and potentiometer 37 increases above the voltage at the junction between resistors 38 and 39, operational amplifier 40, which operates as a comparator, suddenly goes to low voltage level. This may be seen in waveform G, which is applied to one input of both NAND gates 42 and 44. Since the input signals to those NAND gates are at low level, NAND gates 42 and 44 are inhibited from providing an output signal to inverting buffers 42 and 46. Since their output levels are high, the output levels from inverting buffers 45 and 46 on leads 47 and 48 are low level, and an external switch controlling the power to the parking lot is inhibited.

At temperatures which generate voltages applied to the inverting input of operational amplifier 40 which are below the threshold which is established at the non-inverting input, the output level at operational amplifier 40 is at high voltage level, and does not inhibit NAND gates 42 and 44.

At very low temperatures, for example −30° F., the duty cycle of the signals generated by timers 30 and 31 could exceed 50%. It is preferred to maintain the duty cycle at 50% in order that only one-half of the parking lot outlets, each half controlled by the signals on respective leads 47 and 48 should be energized at a particular time. NAND gate 44 is forced to maintain a 50% duty cycle by the application of the waveform B signal from the $\overline{Q}$ output of flip flop 29 to NAND gate 44 and the application of the waveform C signal from the Q output of flip flop 29 to NAND gate 42. The respective NAND gates are thereby forced to maintain a 50% duty cycle.

The aforenoted circuit provides means for controlling the application of power to a pair of loads with a predetermined cycle time, where the duty cycles of the "on" periods are variable according to the temperature. As the temperature increases, the duty cycle for controlling the power on period decreases, and conversely the duty cycle increases as the temperature decreases. Below a predetermined temperature, the duty cycles are fixed at 50%, and above a predetermined temperature, the duty cycles are zero, that is, the controlling signal is of the form as to shut off an external switch.

The principles of the invention may also be used to control a single group of parking lot outlets. In this case one of the timers 30 or 31, with its associated NAND gate circuit can be eliminated. Further, if it desired in the latter case to allow the duty cycle to increase to more than 50%, the connection between the output of flip flop 29 and the retained NAND gate may be eliminated.

Further, in the event that more than two groups of electrical outlets is to be controlled, a decimal counter can be substituted for flip flop 29, each output driving an individual timer such as timers 30 and 31.

To measure wind chill instead of temperature, a heat sink and a resistor connected from +V to ground should be located in the vicinity of thermistor 36.

It should be noted that for the embodiments described, and in the claims, the apparatus can be controlled by the wind chill, rather than the temperature, and thus the term "temperature" is specifically intended to be construed to include the meaning of "wind chill".

The above-described circuits thus provide a means for controlling electrical power outlets, or other apparatus, whereby the supplied power decreases significantly, with reduced requirement dictated by increase in ambient temperature. As such it is also useful to control other kinds of loads such as boilers, etc., as may be usefully desired.

A person skilled in the art understanding this invention may now conceive of additional embodiments or variations. All are considered within the sphere and scope of the invention as defined in the claims appended hereto.

We claim:

1. A temperature controlled timer comprising:

(a) a clock having a settable alarm time output adapted to provide a signal pulse having a leading edge at said set time, (b) a first interval timer connected in a circuit path to said alarm output adapted to begin timing a first interval of time upon detection of said leading edge, (c) a temperature sensor connected to the interval timer for controlling the duration of said first interval of time with temperature, (d) a second interval timer connected in a circuit path to the first interval timer adapted to begin timing a second interval of time following the end of the first interval of time, (e) manual control means for controlling the duration of the second interval of time, and (f) an output circuit for generating a power control signal during the second interval of time, (g) the temperature sensor being adapted to generate a signal to progressively and continuously increase the duration of the first interval of time with increase in temperature whereby the second interval of time is reduced to zero at a predetermined temperature.

2. A temperature controlled timer comprising:

(a) a clock having means to provide an output signal having a leading edge at a predetermined time, (b) first differentiating means for receiving the output pulse and for differentiating it, (c) first timer means having a trigger input for receiving the differentiated signal, and a timing signal input, (d) means for sensing the ambient temperature for generating a voltage dependent on the ambient temperature and applying it to a timing signal input of the first timer, for establishing the duration of the first timing output pulse, (e) second differentiating means for receiving the first timing output pulse and differentiating it, (f) second timer means for having a trigger input for receiving the differentiated signal from the second differentiating means and for providing a second timed output pulse having a leading edge at the time of reception of the differentiated signal at its trigger input, (g) a manually settable timing circuit having means for providing a voltage related to the desired duration time for the second timed output pulse, and an output lead for carrying the output pulse, for connecting to an external switch operable by the second timed output pulse.

3. A temperature controlled timer comprising:

(a) a clock having means to provide an output signal having a pulse edge at a predetermined time, (b) a first interval timer connected in a circuit path to said alarm output adapted to begin timing a first interval of time upon detection of said pulse edge, (c) a temperature sensor connected to the interval timer for controlling the duration of the first interval of time with temperature, (d) a second timer connected in circuit path to the first interval timer adapted to begin timing a second interval of time following the end of the first interval of time, (e) manual control means for controlling the duration of the second interval of time, and (f) an output circuit for generating a power controlling signal during the second interval of time.

4. A temperature controlled timer as defined in claim 3, in which the clock is adapted to cycle the application of said power on and off for predetermined periods of time, and including circuit means adapted to reduce the on portion and increase the off portion in each cycle with increase in ambient temperature.

5. A temperature controlled timer as defined in claim 4, including means for controlling the cycling of said power on and off to about a 50% duty cycle in the event the ambient temperature is at or below a predetermined lower temperature.

6. A temperature controlled timer as defined in claim 3, in which the second interval of time controlled by the second timer is defined by the shut-off time of the timer.

7. A temperature controlled timer comprising a first flip flop for generating a first pulse control signal having a predetermined duty cycle, ambient temperature sensing means for providing a voltage to the flip flop which is related to the ambient temperature, first means for controlling the duty cycle of the control signal in response to said voltage to increase the on time and decrease the off time with increase in ambient temperature, means for applying the first control signal to a comparator circuit, means for generating a predetermined potential when said voltage reaches a level upon the ambient temperature rising to a predetermined temperature and for applying said potential to the comparator circuit, means in the comparator circuit for providing an output control signal in synchronism with the pulse control signal, and for inhibiting the provision of the output control signal upon reception of the predetermined potential, and a second flip flop operated in synchronism but with opposite polarity pulses as the first flip flop and adapted to generate a second pulse control signal having said predetermined duty cycle but of opposite polarity, and being adapted to receive said voltage related to the ambient temperature, second means for controlling the duty cycle of the second control signal in response to said voltage, whereby the second control signal is adapted to control the on or off state of a second switch, means for applying the second control signal to a second comparator circuit with said predetermined potential, and means in the comparator circuit for providing a second output control signal in synchronism with the pulse control signal and for inhibiting the provision of the output control signal upon reception of the predetermined potential.

8. A temperature controlled timer comprising a first flip flop for generating a first pulse control signal having a predetermined duty cycle, ambient temperature sensing means for providing a voltage to the flip flop which is related to the ambient temperature, first means for controlling the duty cycle of the control signal in response to said voltage to increase the on time and decrease the off time with increase in ambient temperature, means for applying the first control signal to a comparator circuit, means for generating a predetermined potential when said voltage reaches a level upon the ambient temperature rising to a predetermined temperature and for applying said potential to the comparator circuit, means in the comparator circuit for providing an output control signal in synchronism with the pulse control signal, and for inhibiting the provision of the output control signal upon reception of the predetermined potential, a second flip flop operated in synchronism but with opposite polarity pulses as the first flip flop and adapted to generate a second pulse control signal having said predetermined duty cycle but of opposite polarity, and adapted to receive said voltage related to the ambient temperature, second means for controlling the duty cycle of the said voltage, means for applying a 50% duty cycle signal to the comparator circuit, and means for adapting both comparator circuits to inhibit generation of output control signals having duty cycles in excess of 50%.

9. A temperature controlled timer as defined in claim 8 including clock means having an output signal for driving said flip flops with a 50% duty cycles, in which each comparator circuit is comprised of a 3 input NAND gate, one input of each said NAND gate being connected to the output of the clock means, a second input of each NAND gate being connected to the output of a corresponding flip flop, and the third input of each NAND gate being connected to the output of said means for generating said predetermined potential.

* * * * *